United States Patent [19]

Thompson et al.

[11] Patent Number: 5,042,381

[45] Date of Patent: Aug. 27, 1991

[54] PRINTING INK FOUNTAIN HAVING A DISPOSABLE LINER

[76] Inventors: Mark J. Thompson, 9912 Pleasant Ave. South, Bloomington, Minn. 55420; Jennings I. Thompson, 10449 Morris Rd., Bloomington, Minn. 55437

[21] Appl. No.: 509,030

[22] Filed: Apr. 13, 1990

[51] Int. Cl.[5] ..... B41F 31/02

[52] U.S. Cl. ..... 101/364; 101/363; 101/210; 101/350; 118/259

[58] Field of Search ..... 101/350, 363, 364, 210, 101/349; 118/259, 260; 222/576, 577; 15/257.07

[56] References Cited

U.S. PATENT DOCUMENTS

| | | | |
|---|---|---|---|
| 3,094,924 | 6/1963 | Stark | 101/364 X |
| 3,097,597 | 7/1963 | Visser | 101/364 |
| 3,318,239 | 5/1967 | Wintzer | 101/364 |
| 4,092,922 | 6/1978 | Schweitzer | 101/363 |

*Primary Examiner*—Edgar S. Burr
*Assistant Examiner*—C. A. Bennett
*Attorney, Agent, or Firm*—Gregory P. Kaihoi; James R. Haller; Mary P. Bauman

[57] ABSTRACT

A printing ink fountain having a disposable liner made of paperboard or the like for use with flexographic printing presses. The liner, which is supported in a liner retainer, is generally upwardly open to receive therein a metering roller of the printing press. The liner includes a flexible drain hose attached to the bottom thereof for draining ink from the liner.

15 Claims, 6 Drawing Sheets

33
34
29
32
37
24
28
23
22
26
25
27
20
29
32
34
33

PRINTING INK FOUNTAIN HAVING A DISPOSABLE LINER

FIELD OF THE INVENTION

The invention relates to printing ink fountains for use on printing presses, and more specifically relates to a printing ink fountain having a disposable liner.

BACKGROUND OF THE INVENTION

Flexographic printing presses commonly utilize an upwardly open ink fountain or tray for holding a reservoir of ink. Typically, a metering roller is partially submerged in ink in the fountain, the metering roller picking up the ink and transferring it to an anilox roller, which in turn passes the ink along through a series of rollers eventually to the paper being printed. When the ink color is to be changed, the remaining ink in the fountain must be drained, and the residual ink cleaned from the rollers and the fountain. Cleaning of the fountain itself, including the drain tube, is time-consuming, and it is critical that all residual ink be cleaned away so as not to contaminate the color of the next run on the press.

Plastic disposable fountains have been utilized on some presses to eliminate the need for cleaning the fountain, and thus assuring no contamination from residual ink in the fountain. Such disposable plastic fountains must be structurally sturdy, and hence, use a considerable amount of plastic, thereby involving commensurate expense. As most plastics are petroleum-derived, the cost of such fountains is at least indirectly driven by petroleum prices and availability.

SUMMARY OF THE INVENTION

The invention relates to a printing ink fountain comprising a relatively sturdy liner retainer that is generally upwardly open, and a disposable liner, preferably paper-based, carried in the liner retainer. The disposable liner is also generally upwardly open, so that a printing roller may be disposed at least partially therein. The liner includes a flexible drain hose attached to the bottom thereof for draining excess ink from the liner.

In a preferred embodiment, the liner includes wiper holding means disposed on two opposing sides for holding roller end wipers against opposite ends of the printing roller. Preferably, the wiper holding means includes an orifice sized to snugly receive therein a wiper, as well as support means spaced outwardly of the orifice from the respective end of the roller for supporting the wiper against the end of the roller.

The disposable liner preferably is made by cutting and folding a paper-based sheet into the desired configuration. The paper-based sheet is very inexpensive to manufacture, and uses little or no petroleum based products.

BEST MODE FOR CARRYING OUT THE INVENTION

Figure 1:
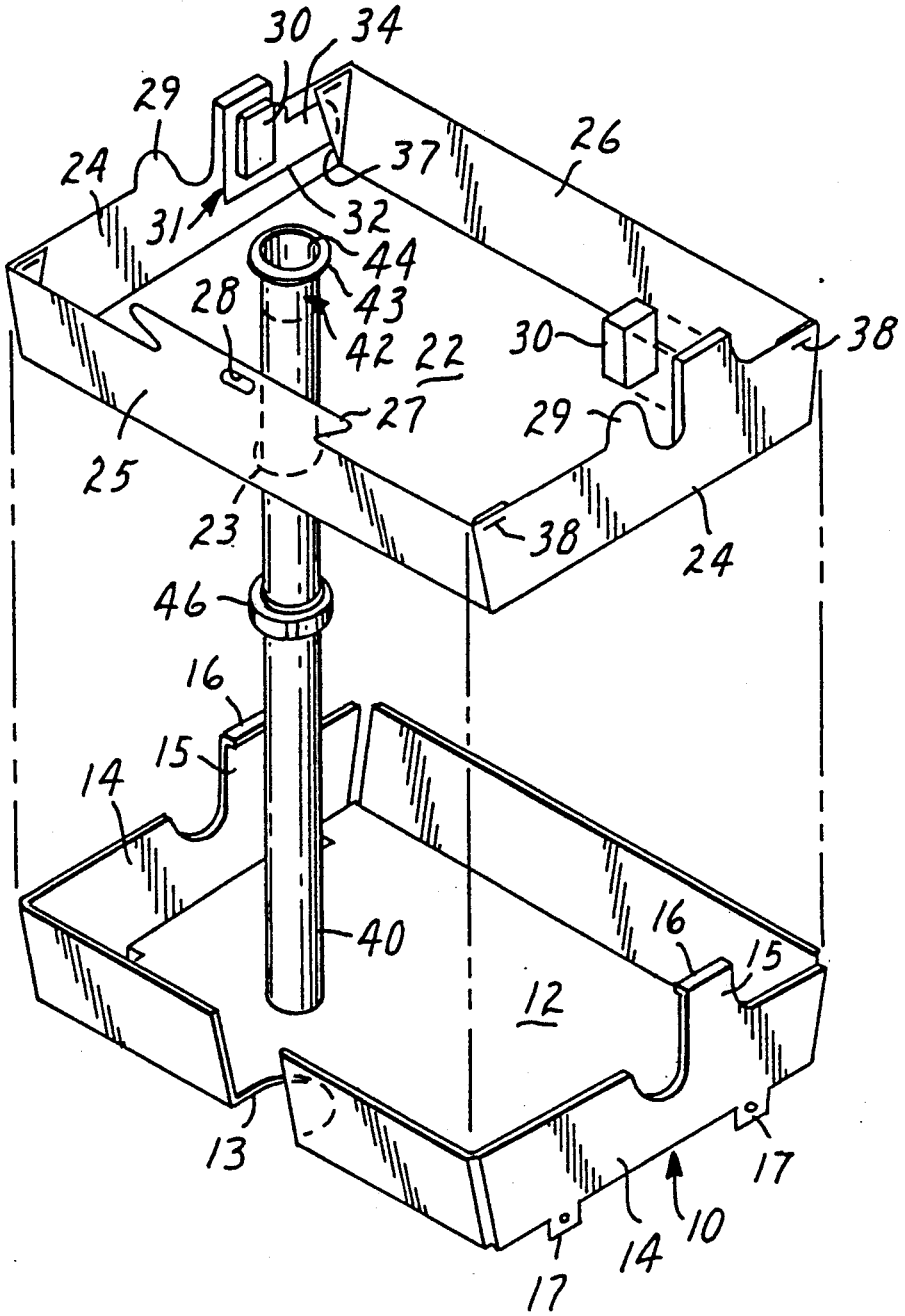
FIG. 1 is an exploded, perspective view of the invention.

A printing ink fountain according to the invention is usable with printing presses of the type having a metering roller (18) picking up ink out of a tray-type fountain, passing the ink along to subsequent rollers (19) for application to the print paper. The fountain of the invention includes a relatively rigid liner retainer (10) for supporting a comparatively lightweight, disposable liner (20) in which the ink is contained.

The liner retainer (10) includes a bottom (12) and sides (14), and is generally upwardly open, allowing a metering roller (18) and anilox roller (19) to be partially disposed therein. The liner retainer (10) preferably is manufactured from a relatively rigid material, such as aluminum or other suitable metal or structural plastics, for example. Mounting brackets (17) or the like may be provided in appropriate locations on the retainer (10) for mounting it to the printing press; these brackets (17) may vary in size, shape, and location depending upon the particular printing press.

The retainer (10) preferably includes a pair of upstanding ears (15) on opposing sides (14), and adjacent lips (16) associated with the ears (15) for assisting in retaining the disposable liner (20) in the desired position. An opening such as relief slot (13) is provided to accommodate the drain tube (40); a slot is preferred to a simple orifice in that it eliminates the need to thread the drain tube (40) therethrough.

Figure 2:
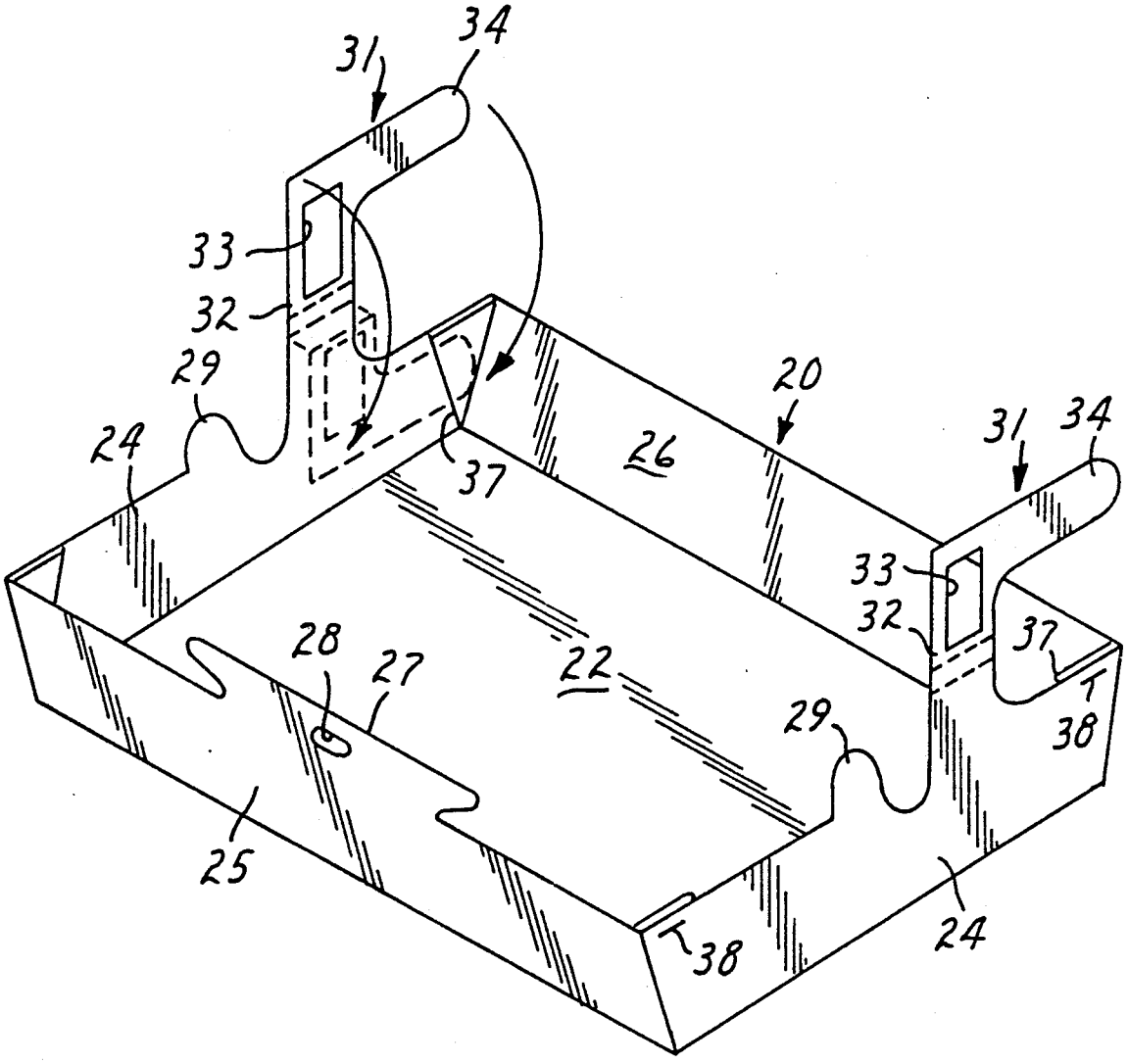
FIG. 2 is a perspective view of the disposable liner of the invention.

The disposable liner (20) is sized and shaped to be closely received within the liner retainer (10), and includes a bottom (22), lateral sides (24), a "front" side (25) and a "rear" side (26) (the term "front" and "rear" being arbitrarily selected to correspond to the orientation of the liner (20) shown in FIGS. 1 and 2). The liner is preferably made of a paper-based substrate, desirably coated on its inner surface with a thin film that is impervious to the type of ink to be used. Typically, a coating of polyethylene, commercially available from such suppliers as Georgia-Pacific, works well when coated on, e.g., 0.024 point paperboard. The liner could alternately be manufactured from other similarly inexpensive disposable materials, including. e.g., chip board, corrugated paper, solid bleachboard, or pulp slur.

Figure 6:
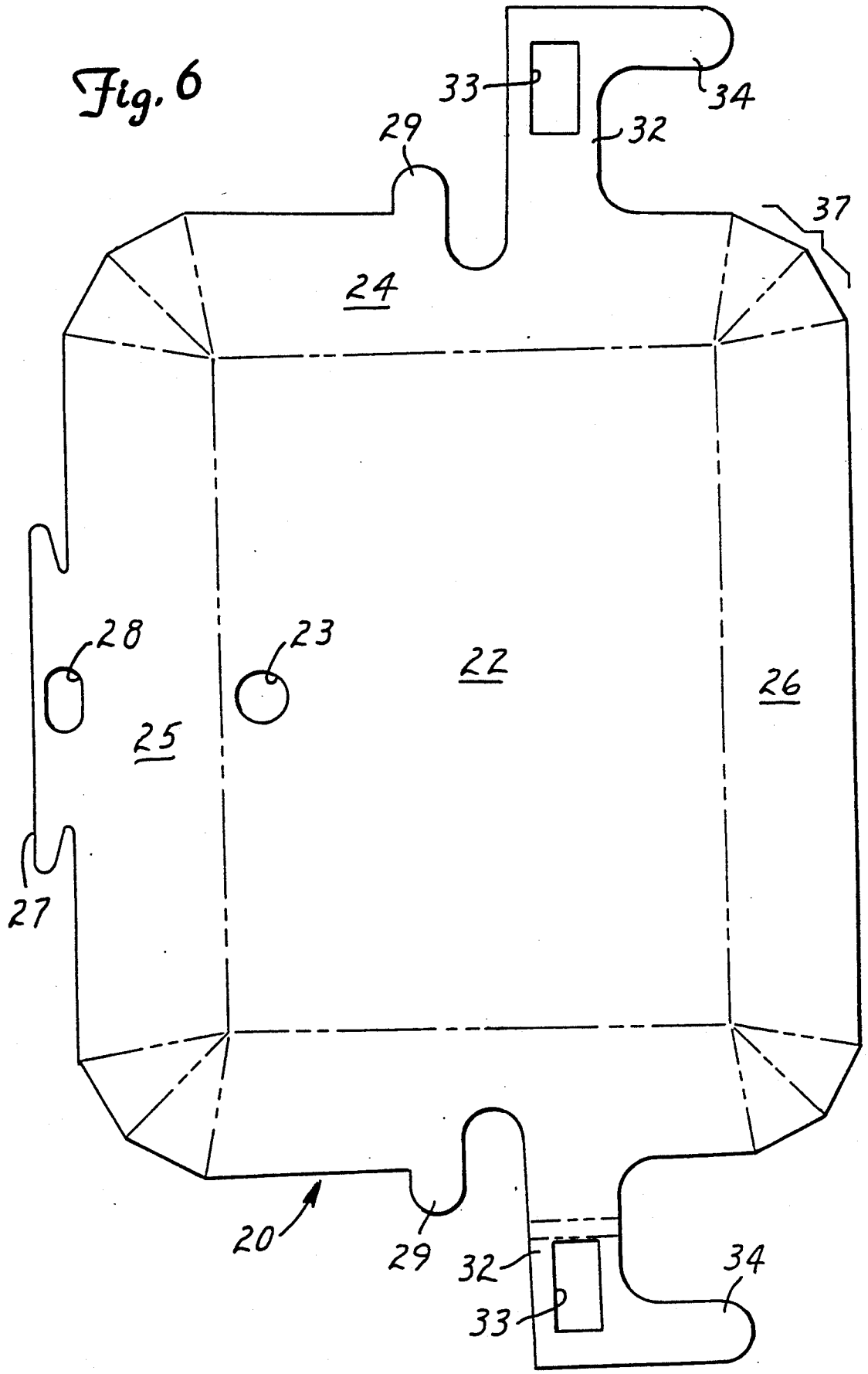
FIG. 6 is a plan view of an unassembled disposable liner of the invention.

FIG. 6 depicts a preferred configuration for a sheet paper-based liner (20) prior to assembly. Units may be die cut according to the pattern shown in FIG. 6 and then folded along the lines indicated in FIG. 6 to form the configuration depicted in FIG. 2. By folding the corners in this manner, the liner (20) is assembled without any seams needing to be sealed. When folded as indicated in FIG. 2, the corners may be fastened by any suitable means, such as staples (38).

A drain hole (23) is provided in the bottom (22) of the liner (20). Mounted in this hole (23) is a drain tube (40). The tube (40) may be attached by any conventional means. In the preferred embodiment depicted in the drawings, the attachment means includes a drain spout (42) having a generally cylindrical body (44) and an upper rim (43) that rests against the top surface of the liner bottom (22). A collar (46), which may be threadingly received on the spout (42) snugly affixes the drain spout (42) to the liner (20).

The tube (40) may be then attached to the drain spout (42) in any conventional fashion. In the preferred embodiment shown in the drawings, the drain tube (40) comprises a thin, highly flexible polyethylene hose (or similar suitable material) that is pinched by the collar (46) against the drain spout (42). For example, polyethylene film having a thickness of about 0.003-0.006 inches works well. Alternately, a thicker (but still flexible) hose, such as of PVC, may be attached to the drain spout (42) by a compression ring, clamp, or similar device. In such an embodiment, preferably the cylindrical body (44) of the drain spout (42) has an outer diameter that tapers inwardly toward the bottom of the cylindrical body (44). The drain spout and collar may be made of any suitable materials, including injection molded polyethylene, for example.

In a preferred embodiment, the liner (20) includes a wrapping core (27) about which the flexible drain tube (40) may be wrapped during storage and shipment of the device. The wrapping core (27) may comprise simply a structure such as shown in FIGS. 1-2 extending upwardly from the side (25) of the liner (20). If desired, an orifice (28) may be provided for placing the end of the tube (40).

For printing presses having roller end wipers located adjacent the ink fountain, the liner (20) may include disposable wipers (30) retained in wiper holding means (31). Though the precise configuration of such means for holding the wiper (30) may vary from one press to another, in a preferred embodiment the wiper holding means (31) includes a tab (32) formed integrally with the liner (20) folded over inwardly as shown in FIG. 2. The tab includes means for supporting the wiper (30), preferably an orifice (33) of a size slightly smaller than the compressible body of the wiper (30). The wiper (30) itself may be made of any suitable material, but desirably is compressible and sponge-like to accomplish its wiping purpose. It thus may be sized slightly larger than the orifice (33), and is held therein by an interference fit.

Figure 3:
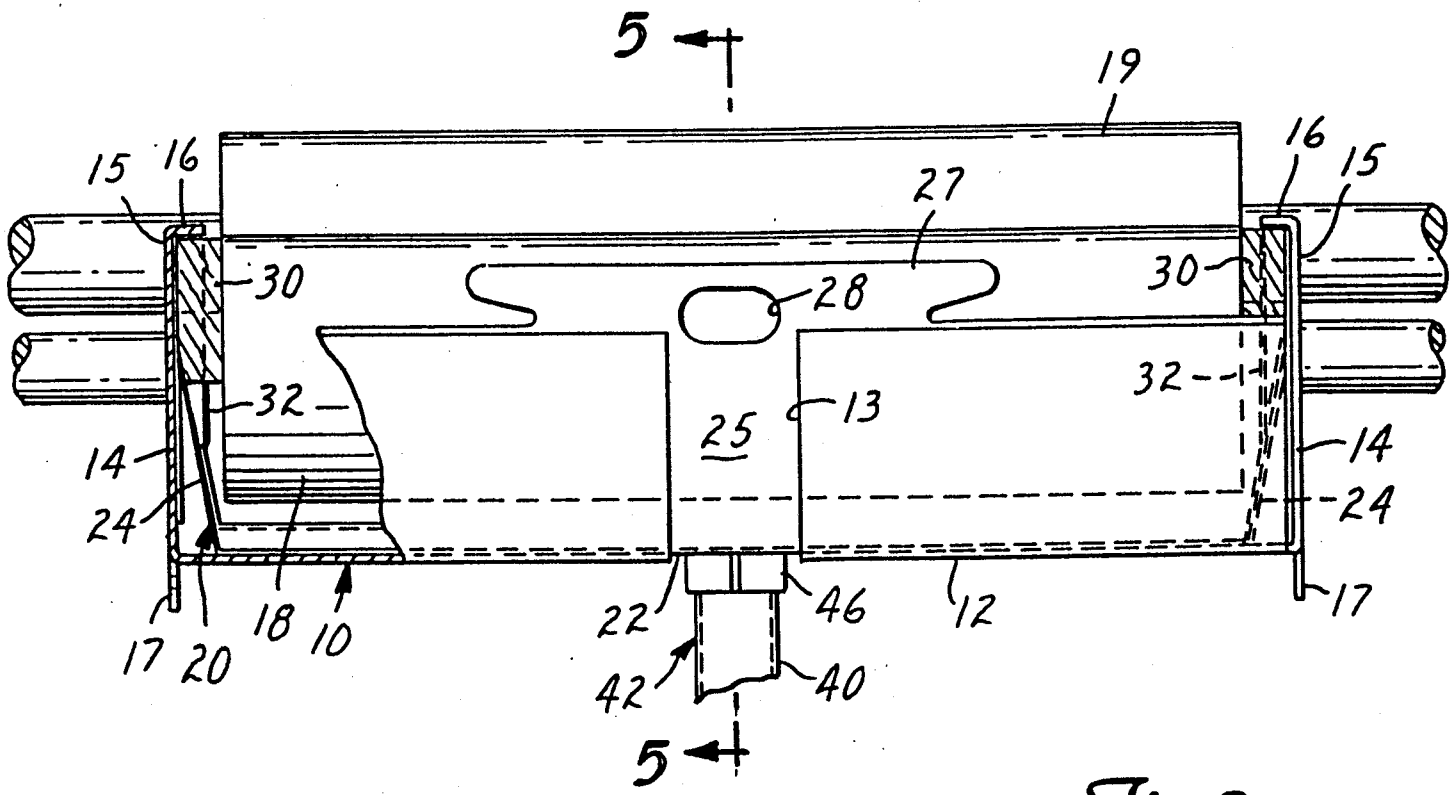
FIG. 3 is a front elevational view, partially broken away, of the invention.
Figure 4:
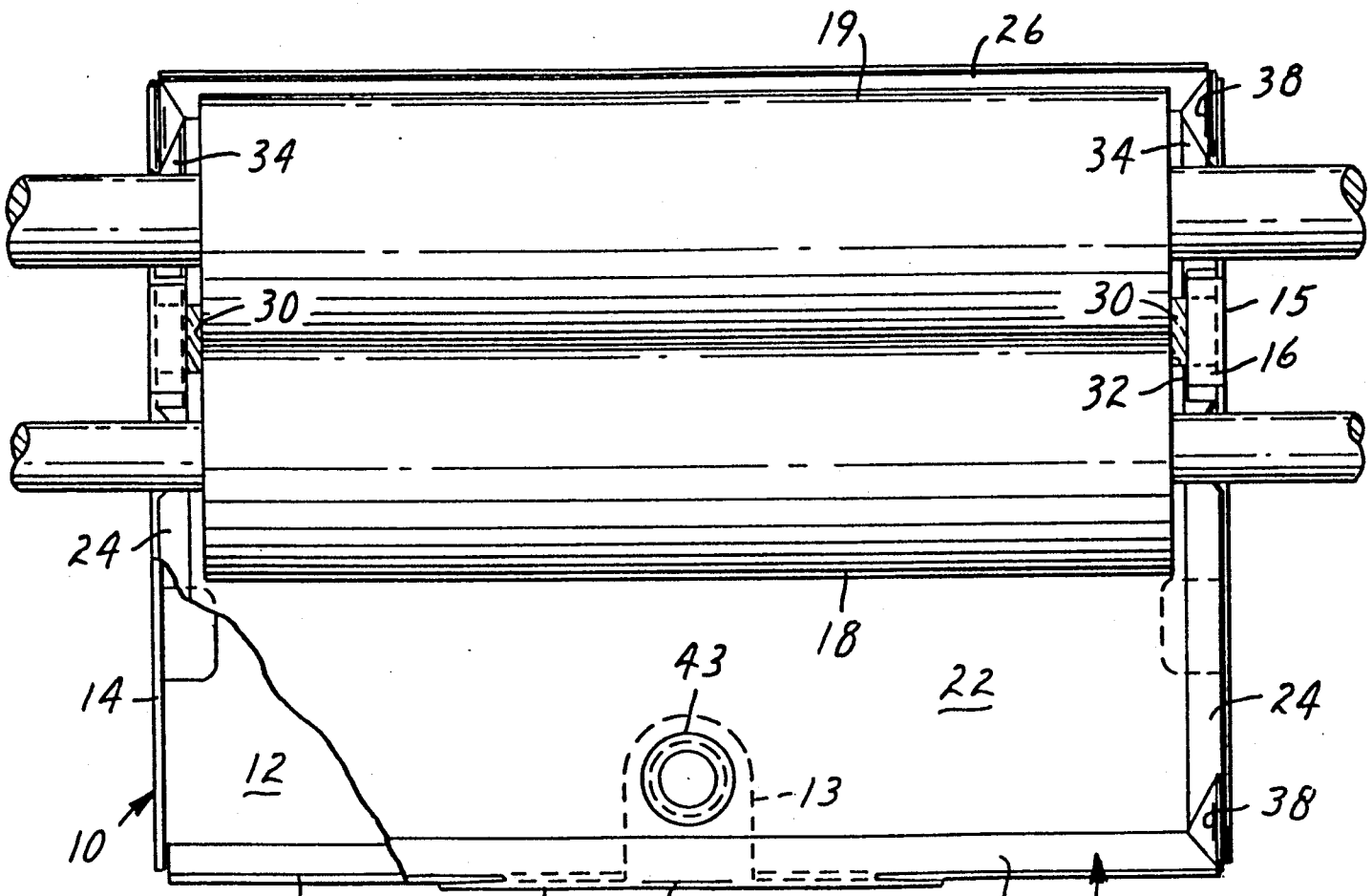
FIG. 4 is a top, plan view of the invention.
Figure 5:
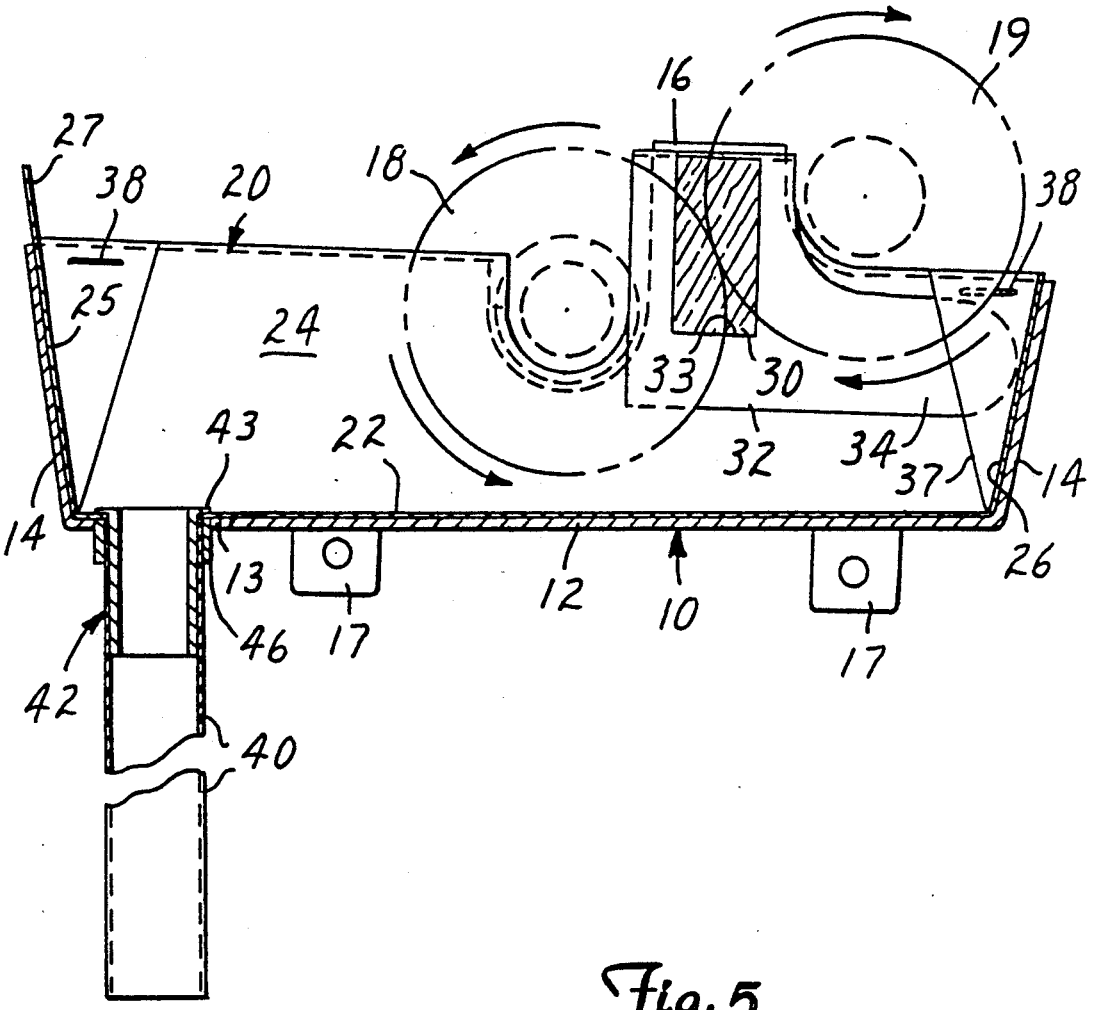
FIG. 5 is a cross-sectional view taken along line 5—5 of FIG. 3.

As shown in FIG. 3, desirably the tab (32), when folded into position, is spaced inwardly of the adjacent side (24) of the liner (20). Preferably, the wiper holding means (31) also includes a projection (34) extending toward the rear side (26) of the liner (20). The end of the tab is then receivable in a pocket (37) formed in the corner of the liner (20) by the folds made during assembly of the liner (20). In this configuration, the projection (34) assists both in maintaining the proper orientation of the wiper holding means (31) during storage and transportation, and also adds dimensional stability during use on the printing press.

Moreover, desirably the orifice (33) and tab (32) are positioned such that the wiper is supported against the end(s) of the roller(s) by the side (24) of the liner (20) and by the ears (15) and lips (16) of the liner retainer (10). The wipers may be supplied either separately or pre-assembled in the liners (20), and desirably are disposable, being discarded along with the liner (20) after use.

To ease removal of the liner from the retainer the liner may be provided with thumb tabs (29) (as shown in FIGS. 1, 2, and 6) that extend upwardly from a side of the liner. The thumb tabs therefor extend upwardly beyond the upper edge of the adjacent retainer, and can be easily grasped without soiling ones hands with ink.

In use, a liner retainer (10) is attached to the printing press by suitable mounting brackets (17), replacing the original permanent ink fountain. Disposable liners (20) are manufactured to closely fit within the liner retainer (10). The dimensions of both of these units will vary from one press to another. The drain tube (40), if coiled about a wrapping core (27), is uncoiled, and either is clamped off by a suitable means or the end is threaded through orifice (28) or otherwise secured above the level of the printing ink in the liner (20). Printing ink may then be added to the liner as desired.

When the printing run is completed and the ink color is to be changed, the remaining ink in the liner (20) may be drained into a suitable container (such as the original ink bottle) by lowering and/or unclamping the drain tube (40). The disposable liner (20), including disposable wipers (30), if any, may then be removed from the liner retainer (10) and discarded, and a fresh liner (20) inserted after cleaning of the rollers.

In some applications, the wipers (30) may be included on other structure on a printer, and in some applications, it may not be necessary to supply a new liner retainer—the existing permanent ink fountain may be adaptable to serve as the liner retainer.

While a preferred embodiment of the present invention has been described, it should be understood that various changes, adaptations and modifications may be made therein without departing from the spirit of the invention and the scope of the appended claims.

What is claimed is:

1. A printing ink fountain comprising a liner retainer having a bottom and sides and being generally upwardly open so that a printing roller may be disposed at least partially therein, and a disposable liner having a bottom and sides sized and shaped to be closely received within the retainer, and being generally upwardly open so that a printing roller may be disposed at least partially therein, the liner including a flexible drain hose attached to the bottom thereof for draining ink from the liner.

2. The liner of claim 1 wherein the liner includes wiper holding means disposed on two opposing sides for holding roller end wipers against opposite ends of the printing roller.

3. The liner of claim 2 wherein each wiper holding means includes means defining an orifice sized to snugly receive therein a wiper.

4. The liner of claim 3 wherein the wiper holding means includes support means spaced outwardly of the orifice from the respective end of the roller for supporting the wiper against the end of the roller.

5. The fountain of claim 1 wherein the liner includes a wrapping core about which the flexible hose may be wrapped.

6. The fountain of claim 5 wherein the wrapping core extends generally upwardly from a side of the liner in an orientation so that when the hose is wrapped about the core the hose does not interfere with placement of the liner into the retainer.

7. The liner of claim 1 wherein the liner is made of a generally flat paper-based material folded into the desired insert shape.

8. A printing ink fountain comprising:

a liner retainer having a bottom and sides and being generally upwardly open so that a printing roller may be disposed at least partially therein;

a disposable liner having a bottom and sides sized and shaped to be closely received within the retainer, and being generally upwardly open so that a printing roller may be disposed at least partially therein;

wiper holding means disposed on two opposing sides of the liner for holding roller end wipers against opposite ends of the printing roller, each wiper holding means including means defining an orifice, sized to snugly receive therein a wiper, and support means spaced outwardly of the orifice from the respective end of the roller for supporting the wiper against the end of the roller; and a flexible drain hose attached to the bottom of the liner for draining ink from the liner;

the liner including a wrapping core about which the flexible hose may be wrapped, the wrapping core extending generally upwardly from a side of the liner in an orientation so that when the hose is wrapped about the core the hose does not interfere with placement of the liner into the liner retainer.

9. The fountain of claim 8 wherein the retainer includes an opening for receiving therethrough the flexible drain hose.

10. The fountain of claim 9 wherein the opening includes a slot formed in one of the sides of the retainer to facilitate placement of the liner in the retainer.

11. A disposable insert for a printing ink fountain of the type having a bottom and sides and being generally upwardly open s that a printing roller may be disposed at least partially therein comprising:

a disposable liner having a generally flat bottom and upwardly folded edge-portions defining sides sized and shaped to be closely received within the fountain, the bottom of the liner including an orifice therein; and a flexible drain hose attached to the bottom at the orifice for draining ink from the liner.

12. The insert of claim 11 wherein the liner includes wiper holding means disposed on two opposing sides for holding roller end wipers against opposite ends of the printing roller.

13. The insert of claim 12 wherein each wiper holding means comprises a tab extending from one of the sides, the tab having an orifice therein and being folded over inwardly to a position spacing the orifice from the side of the liner, the orifice being sized to receive and retain a wiper.

14. The insert of claim 13 wherein a corner of the liner adjacent each tab is folded to form a laterally open pocket, the tab including a projection extending laterally from the orifice, the projection being receivable in the pocket to stabilize the tab.

15. A disposable insert for a printing ink fountain of the type having a bottom and sides and being generally upwardly open so that a printing roller may be disposed at least partially therein comprising:

a disposable liner having a generally flat bottom and upwardly folded edge-portions defining sides sized and shaped to be closely received within the retainer, the bottom of the liner including an orifice therein;

a flexible drain hose attached to the bottom at the orifice for draining ink from the liner; and wiper holding means disposed on two opposing sides for holding roller end wipers against opposite ends of the printing roller, each wiper holding means comprising a tab extending from the side, the tab having an orifice therein and being folded over inwardly to a position spacing the orifice from one of the sides of the liner, the orifice being sized to receive and retain a wiper;

a corner of the liner adjacent each tab being folded to form a laterally open pocket, the tab including a projection extending laterally from the orifice, the projection being receivable in the pocket to stabilize the tab.

* * * * *